United States Patent [19]

Bosyj et al.

[11] Patent Number: 4,831,685

[45] Date of Patent: May 23, 1989

[54] WET AND DRY VACUUM CLEANER

[75] Inventors: Nick M. Bosyj, North Canton; John A. Leonatti, Uniontown; Vincent L. Weber, Canton; Gregory P. Wagner, Akron, all of Ohio

[73] Assignee: The Hoover Company, North Canton, Ohio

[21] Appl. No.: 126,021

[22] Filed: Nov. 27, 1987

[51] Int. Cl.[4] ..... A47L 5/24; A47L 9/12; A47L 9/18

[52] U.S. Cl. ..... 15/344; 15/347; 15/353; 55/332; 55/373; 55/DIG. 2; 55/DIG. 3

[58] Field of Search ..... 15/344, 353, 347, 350; 55/332, 334, 372, 373, 464, DIG. 2, DIG. 3

[56] References Cited

U.S. PATENT DOCUMENTS

| | | | |
|---|---|---|---|
| 948,993 | 2/1910 | Hemmer | 55/334 |
| 1,230,827 | 6/1917 | Duffie . | |
| 1,363,859 | 12/1920 | Fetters et al. . | |
| 2,091,537 | 8/1937 | Wahlborg . | |
| 2,153,580 | 4/1939 | Lynger . | |
| 2,226,630 | 12/1940 | McCord . | |
| 2,233,167 | 2/1941 | Holm-Hansen | 15/353 |
| 2,306,212 | 12/1942 | Gerstmann | 15/353 X |
| 2,617,138 | 11/1952 | Brown et al. . | |
| 2,638,362 | 5/1953 | Sherman et al. | 285/91 |
| 2,639,005 | 5/1953 | Gerstmann . | |
| 2,693,000 | 11/1954 | Minerley | 15/320 |
| 2,737,263 | 3/1956 | Anderson . | |
| 2,814,357 | 11/1957 | Bowman . | |
| 2,863,525 | 12/1958 | Lucian | 55/334 |
| 2,886,127 | 5/1959 | Brock . | |
| 2,974,346 | 3/1961 | Hahn | 15/344 |
| 3,034,273 | 5/1962 | Wallace | 15/353 X |
| 3,079,626 | 3/1963 | Yonkers et al. | 15/320 |
| 3,165,774 | 1/1965 | Barba | 15/353 X |
| 3,267,511 | 8/1966 | Meyerhoefer | 15/353 |
| 3,537,711 | 11/1970 | Walker | 277/12 |
| 3,618,297 | 11/1971 | Hamrick | 55/216 |
| 3,856,488 | 12/1974 | Kato et al. | 55/300 |
| 3,939,527 | 2/1976 | Jones | 15/353 |
| 4,011,624 | 3/1977 | Proett | 15/344 |
| 4,055,405 | 10/1977 | Thun-Hohenstein | 55/332 X |
| 4,137,599 | 2/1979 | Steyer | 15/353 X |
| 4,142,270 | 3/1979 | Nauta | 15/353 |
| 4,209,875 | 7/1980 | Pugh et al. | 15/344 |
| 4,341,540 | 7/1982 | Howerin | 55/307 |
| 4,364,757 | 12/1982 | Leonatti | 55/357 |
| 4,367,565 | 1/1983 | Parise | 15/321 |
| 4,542,557 | 9/1985 | Levine | 15/344 |

FOREIGN PATENT DOCUMENTS

| | | | |
|---|---|---|---|
| 100348 | 6/1983 | European Pat. Off. . | |
| 170720 | 12/1986 | European Pat. Off. . | |
| 1152348 | 2/1958 | France . | |
| 1810187 | 7/1969 | German Democratic Rep. . | |
| 3325336 | 1/1985 | German Democratic Rep. . | |
| 782202 | 9/1957 | United Kingdom . | |
| 877883 | 9/1961 | United Kingdom | 15/344 |
| 990065 | 4/1965 | United Kingdom . | |
| 1201841 | 8/1970 | United Kingdom | 55/378 |

*Primary Examiner*—Chris K. Moore

[57] ABSTRACT

A filter, separator and seal arrangement is disclosed for a wet and dry hand held vacuum cleaner. A cup-shaped filter is provided which is elongated to provide a large area for enhancing sustained air performance of the cleaner with the filter being disposed within a liquid separator so as to be generally coextensive therewith. A connection arrangement is also provided between the filter and separator so as to provide an air tight and liquid tight connection therebetween but which is also easily separable to facilitate cleaning of the two devices.

17 Claims, 3 Drawing Sheets

WET AND DRY VACUUM CLEANER

BACKGROUND OF THE INVENTION

This invention relates generally to vacuum cleaners and, more particularly, to vacuum cleaners capable of picking up both liquid and dry material from a surface being cleaned.

In large wet/dry vacuum cleaners, it is easier to design a unit which will provide good liquid separation and storage and also will provide relatively large filter area for maintaining cleaner efficiency when picking up dry material. However, in small units where space is at a premium, the design of unit to provide good liquid separation and storage, and also good filtration capability for dry mode operation becomes much more difficult. As a result, many such compact wet/dry units often sacrifice performance capability in either the wet or dry mode by, for example, reducing dry material filtering capability by use of small filters. A filter with a small filter area will clog or have the filter area substantially reduced within a short period of time thereby reducing air flow through the unit which substantially impedes its ability to pick up both liquid and dry material at its intake nozzle.

Further, compact units such as hand held wet/dry vacuum cleaners are often utilized to pick up liquids other than water such as, for example, milk and cereal spills. Thus, it is highly desirable to provide a compact wet/dry vacuum cleaner which can be easily cleaned after use.

Still further, it is important in any wet/dry unit to provide good seals to prevent liquid spillage from its storage container and also to provide good cleaner performance by assuring that air flow and suction pressure generated by the motor and fan of the cleaner is available at the cleaner's nozzle for pick up of the material. This is particularly important in compact wet/dry vacuum cleaners since often a relatively small power source must be used because of space limitations. Thus, poor seals can substantially reduce performance of the vacuum cleaner and cause spillage of liquid which could damage carpet or other materials.

SUMMARY OF THE INVENTION

Accordingly, a general object of the present invention is to provide a new and improved compact vacuum cleaner for pickup of liquid and dry materials.

A more specific object o the present invention is to provide a new and improved liquid separator and filter arrangement for use in a compact wet/dry vacuum cleaner.

Another object of the present invention is to provide a new and improved sealing arrangement for a compact wet/dry vacuum cleaner.

The foregoing and other objects and advantages of the present invention will become readily apparent from the description hereinbelow when taken in connection with the accompanying drawings.

In carrying out the invention in one form thereof, a vacuum cleaner for pickup of both liquid and dry material is provided having a motor/fan housing and a collection container separably attached thereto. Further, the cleaner is provided with a cup-shaped liquid separator and a cup-shaped filter which is elongated to provide a large filter area for enhancing sustained air performance of the cleaner with the filter being disposed within and generally coextensive with the liquid separator. Still further, a means is provided for providing an air tight and liquid tight separable connection between the filter and separator wherein both are removably mounted within the collection container.

In one aspect of the present invention, a seal member is provided which includes a first seal having a resilient annular lip for establishing a seal with the collection container, and a second seal, which also includes a resilient annular lip or rib and disposed radially inwardly of the first seal providing a seal with the motor/fan housing. Still further, a third seal is provided for establishing a seal with the liquid separator.

DESCRIPTION OF THE PREFERRED EMBODIMENT

Figure 1:
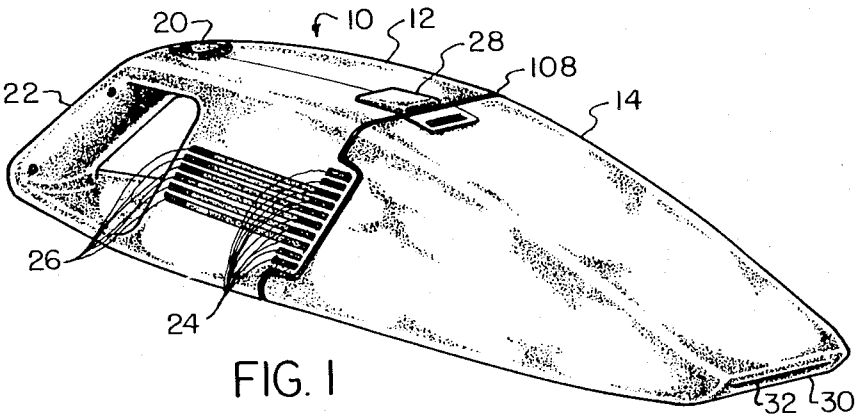
FIG. 1 is a perspective view of a hand held vacuum cleaner embodying one form of the invention.

Referring to FIG. 1, there is illustrated a vacuum cleaner 10 of one type which embodies features of the present invention in one form. The illustrated hand held vacuum cleaner includes two separable housing sections shown as a rearwardly located motor/fan housing 12 and forwardly located collection container or collector cup 14. The motor/fan housing includes a fan 16 (FIG. 3) driven by a motor 18 (FIG. 3) which is controlled by a switch 20. The illustrated motor/fan housing also includes an integral handle 22 and a plurality of main air exhaust vents 24 and motor cooling vents 26 located on each side of the motor/fan housing. A depressable latch 28 provides a separable interconnection between the motor/fan housing and the collection container. A forwardly located nozzle 30 having an opening 32 provides an entrance for air, liquid, dirt, debris and other material into the collection container.

Figure 2:
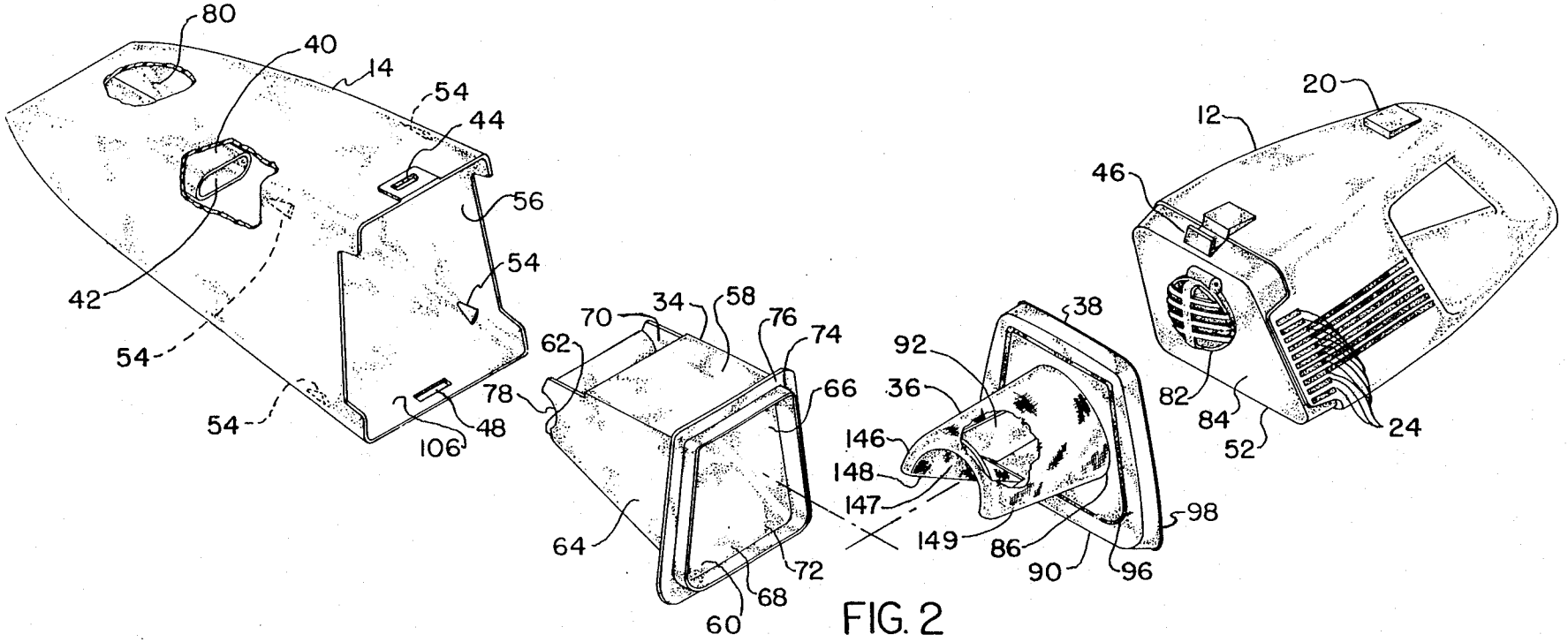
FIG. 2 is an exploded view of the vacuum cleaner of FIG. 1 showing separable components thereof.

As illustrated in FIG. 2, the hand held vacuum cleaner of FIG. 1 comprises separable elements, namely, the motor/fan housing 12, the collection container 14, a liquid separator 34, and a seal and support member 38 having filter 36 attached thereto. The collection container includes an inlet nozzle tube 40 with an outlet opening 42, an aperture 44 for receiving latch tongue 46 located on the motor/fan housing and an aperture 48 for receiving a rib 50 (FIG. 3) projecting downwardly from bottom surface 52 of the motor/fan housing. Four stops 54 are also provided on interior surface 56 of the collection container for positioning the liquid separator horizontally within the collection container.

As also illustrated in FIG. 2, the liquid separator 34 has a generally elongated or cup-shaped configuration with a top wall 58, a bottom wall 60, a front wall 62, and side walls 64 and 66 which establish an interior compartment 68 therewithin which is elongated in generally a horizontal direction. An inlet opening 70 to the compartment or separator interior is established by the top, front and side walls, and an outlet opening 72 is established by the top, bottom and side walls with an annular rim 74 provided about or adjacent to the outlet opening. The separator also includes a peripheral flange 76 adjacent to the outlet opening which facilitates alignment and positioning of the separator within the collection container 14. The flange engages the four stops 54 on the interior surface 56 of the collection container to provide horizontal positioning of the separator within the container and the flange configuration also facilitate separator alignment with the collection container when telescopically positioned therewithin. As also illustrated, the front wall of the separator is formed in an arcuate or concave semicircular configuration across its entire transverse width so as to provide a baffle 78 which redirects liquids and other materials being emitted from the nozzle tube opening 42 back toward a front or forward interior portion 80 of the collection container.

The filter 36 is formed of an air previous material such as, for example, a non-woven nylon fabric with a porous vinyl coating and is attached to support 38. The support may be formed of a flexible and resilient material which also provides adequate structural integrity such as, for example, polyethylene or a thermoplastic elastomeric material. The filter has generally a cup-shaped or bag configuration and is elongated in a horizontal direction away from and in general alignment with fan inlet opening 82 in front wall 84 of the motor/-fan housing 12. An open end 86 of the filter is secured to an annular projecting portion 88 (FIG. 3) integral with flange or cap 90 of the support by any suitable means such as, for example, by heat sealing. The filter is supported within its interior by a frame 92 integral with the flange and extends generally horizontally therefrom. Opening 94 (FIG. 4) is provided in the flange to provide air communication between the filter interior and the fan inlet opening when the illustrated elements are assembled. The flange also includes an annular groove or recess 96 which receives the annular rim or tongue 74 of the liquid separator 34 to provide a separable sealed connection therewith. The flange is also provided with a flexible and resilient annular lip 98 extending about its outermost periphery and two flexible and resilient annular lips or ribs 100 (FIG. 4) located on its front side 102 (FIG. 4) to provide liquid and air tight seals with the collector container interior surface 56 and motor/fan housing front wall, respectively.

The elements illustrated in FIG. 2 are easily separable in the illustrated manner by an operator for cleaning purposes. Reassembly can also be readily accomplished to ready the vacuum cleaner for subsequent vacuuming operation. In reassembly, the liquid separator 34 and the support and seal member 38 are moved together with the elongated or cup-like filter 36 moving telescopically into the separator interior compartment 68 so as to be generally coextensive with the separator walls 58, 60, 64 and 66 thereof. The connection therebetween is accomplished by moving the rim 74 of the separator into the annular groove 96 of the flange 90 with the groove and rim being dimensioned to provide a separable connection means but with a tight frictional fit which also provides a labyrinth seal. The filter and separator combination is then moved into the interior of the collection container 14 with the separator flange 76 facilitating horizontal alignment therebetween. A downwardly projection fin 104 (FIG. 3) of the separator engages bottom interior surface 106 of the container and moves therealong to facilitate vertical alignment of the separator baffle 78 with the outlet opening 42 of the nozzle inlet tube 40. The separator and filter combination are moved within the collection container until the stops 54 are engaged by the separator flange thereby providing the proper longitudinal positioning of the separator and filter. The motor/fan housing 12 and the collection container with the filter and separator therewithin, are then removably connected by positioning the rib 50 (FIG. 3) of the housing within aperture 48 of the container and subsequently pivoting the housing and container toward each other to permit the latch tongue 46 to engage within the aperture 44 of the container.

Figure 3:
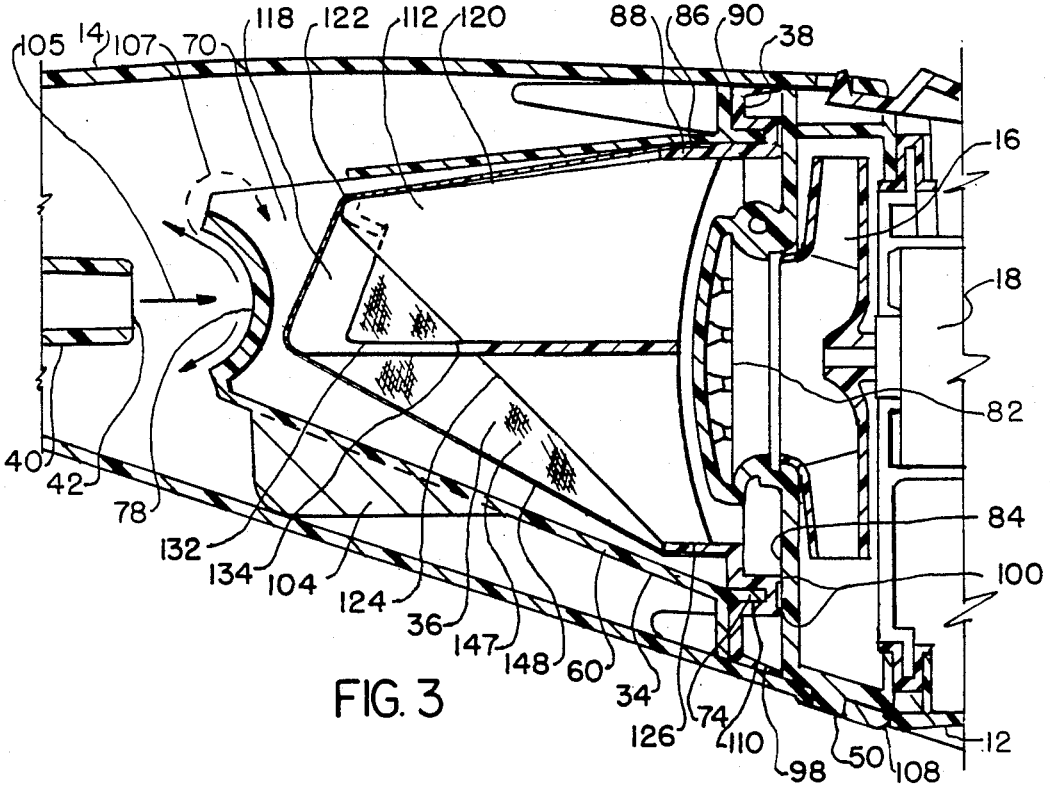
FIG. 3 is a partial cross sectional view, with part of a filter thereof broken away, of the vacuum cleaner of FIG. 1 showing the assembled relationship of the separable components illustrated in FIG. 2.

Operation of the device can best be understood by reference to FIGS. 2 and 3 with it being understood that the cleaning operation takes place with the illustrated elements assembled together as described hereinabove whereby the vacuum cleaner 10 is in the assembled condition illustrated in FIG. 1. Upon operation of the switch 20, the motor 18 which is battery operated in the illustrated arrangement, is energized to drive the fan 16 so as to generate a vacuum and air flow. A mixture of air, dirt, liquid and other particles is drawn into the nozzle opening 32 (FIG. 1), through the tube 40 and out through the tube opening 42. As can be seen in FIG. 3, the tube opening is positioned opposite the baffle 78 so that the emitted mixture, indicated by solid arrowed lines 105 in FIG. 3, impinges thereagainst and is redirected thereby causing separation of the air from the liquid and heavier particles. When the cleaner is in the illustrated horizontal position, the liquid and heavier particles are diverted for storage in the area of the collection container 40 below the tube opening including along the exterior of the side walls 64 and 66 (FIG. 2) and beneath the bottom wall 60 of the liquid separator 34. When the cleaner nozzle 30 (FIG. 1) is oriented downwardly, liquid will be stored in the forward interior portion 80 (FIG. 2) of the container about the nozzle tube. As indicated by dashed arrowed line 107, dust or dirt laden air, which has been separated from the liquid, is drawn through the separator opening 70 into the separator interior compartment 68. Within the compartment, dirt and dust particles entrained in the air are filtered out by the filter 36 with clean or filtered air then being drawn through the bag into the eye or apertured opening 82 which communicates with the fan. The filtered air is then exhausted from the fan via a plurality of exhaust vent openings 24 (FIG. 2) in the motor/fan housing 12.

The partial cross-sectional view of FIG. 3 illustrates the assembled and sealed relationships at the juncture of the collection container 14, the filter 36, the support 38 and the motor/fan housing 12. As can be seen, a first seal is provided by the resilient annular lip 98 located on the outermost periphery of the flange portion 90 of the support. The lip engages and is deflected to the illustrated position so as to provide a liquid and air tight seal thereby inhibiting the flow of any liquid from the container. A second seal is provided by the resilient annular lips or ribs 100 of the flange portion which are spaced radially inwardly of the outer peripheral lip. The resilient ribs provide face seals by their engagement with the front wall 84 of the motor/fan housing. This second seal assures that air flow generated by the fan 16 is drawn through the filter 36 and prohibits the flow of ambient air which might otherwise be drawn from the junction 108 (also see FIG. 1) between the container and motor/-fan housing. The drawing of ambient air would decrease cleaner performance by reducing the air flow and suction pressure at the nozzle opening 32 (FIG. 1). A third seal, which is a labyrinth seal, is provided by the annular grooved portion 110 of the flange which receives the separator rim 74 to establish a tight but separable connection Such sealed interconnection inhibits the flow of liquid from the collection container into the separator interior compartment 68 and also, permits simultaneous removal of the filter and the liquid separator from the container. Such removal expedites emptying of accumulated liquid from the collection container and subsequent filter and separator reinsertion for continuation of a cleaning operation.

Figure 4:
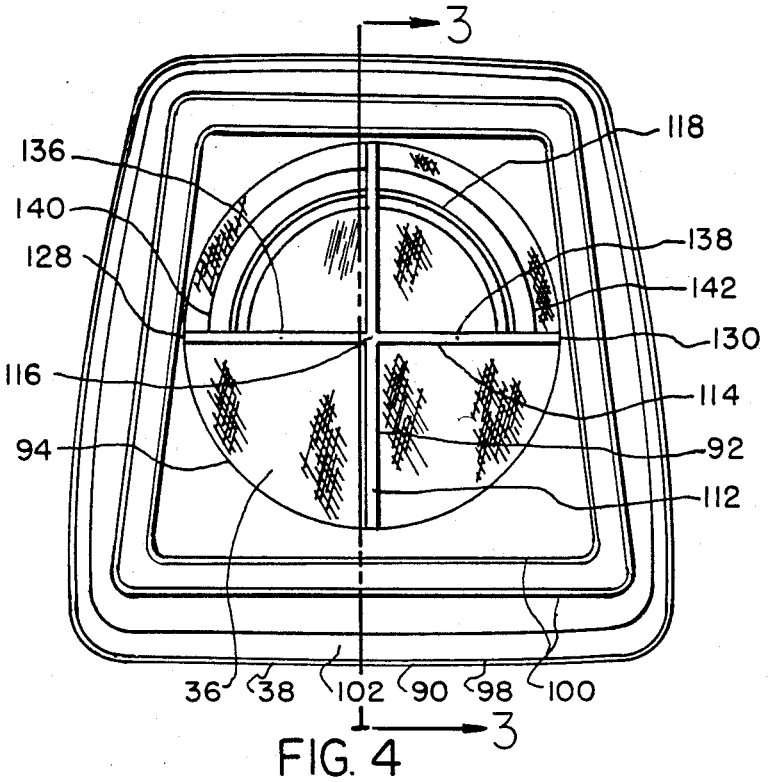
FIG. 4 is a front elevational view of a seal and support member with filter illustrated in FIGS. 2 and 3.

FIG. 4 illustrates a front view of the support and seal member 38 having the opening 94 in its flange 90 communicating with the interior of the filter 36. As illustrated, the annular sealing ribs 100 are spaced radially outwardly of the flange opening 94 and radially inward of the sealing lip 98 formed at the outermost periphery of the support. The filter support frame 92 is integrally connected to the flange and includes a vertical leg 112 and a transverse leg 114 which intersect at a generally central location 116. The frame also includes forwardly located arcuate or semicircular shaped support 118. Referring to FIGS. 3 and 4, the vertical leg is in the form of an inverted triangle or sail with an inverted base 120. The base extends generally horizontally from a midpoint 122 of the arcuate support to the flange and is attached to both. Side 124 of the vertical leg is connected at a bottom location 126 to the flange and is sloped upwardly to also connect to the midpoint of the arcuate support. The transverse leg is a plate-like member connected to the flange at points 128 and 130 and extends across the flange opening. A forward portion 132 of the transverse leg has a centrally located generally U-shaped cutout of a depth indicated by line 134 in FIG. 3 and of a width indicated by dashed lines 136 and 138 in FIG. 4. The forward portion is connected to ends 140 and 142 of the arcuate front support on each side of the U-shaped cutout. The filter is mounted about or over the legs and arcuate support with its open end 86 secured by, for example, by heat sealing or gluing to an annular neck 88 of the flange. As can be seen in FIG. 2, the above described frame provides the filter 36 with an arcuate configuration at its closed end 146 and with a lower central concave portion 147 and two bottom sides 148 and 149 which are upwardly sloped or tapered from its open end 86 to its closed end. When positioned within and generally coextensive with the liquid separator 34 as illustrated in FIG. 3, the upwardly tapered configuration of the filter bottom provides spacing between the filter and the upwardly tapered bottom wall 60 of the liquid separator so as to permit air flow therebetween. Thus, the filter frame configuration functions to increase the area of the bag available for air filtration. A large filter area provides longer sustained air flow and cleaning performance of a vacuum cleaner and by use of a tapered filter such as, for example, the configuration described hereinabove, a filtration area can be provided which is at least two or three times greater than would be attainable were only a flat or planar filter utilized across the filter flange opening.

Figure 5:
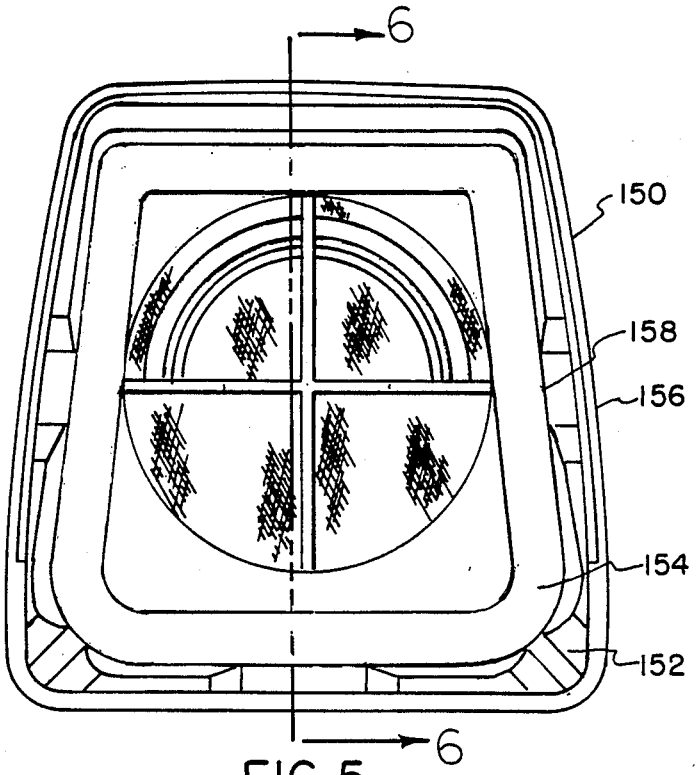
FIG. 5 is a front elevational view of a preferred seal and support member with filter, which was developed for the assignee of the present invention subsequent to development by the inventor of the embodiment illustrated in FIGS. 1–4 and which embodies features of the present invention.

The seal and support member 38 illustrated in FIGS. 2–4 is formed in one piece with the filter 36 attached thereto. The seal and support member can be molded of a thermoplastic material such as, for example, polyethylene. However, it is believed it could also be formed of a thermoplastic elastomer which could provide greater temperature resistance while also providing the desired moldability, flexibility, resiliency and sufficient structural integrity. However, it is believed by the applicant to be preferable to utilize a two piece arrangement as illustrated in FIG. 5. A two piece arrangement permits the annular sealing lips 98 and 100 to be molded of a different material which helps them maintain their sealing characteristics at higher temperatures.

Figure 6:
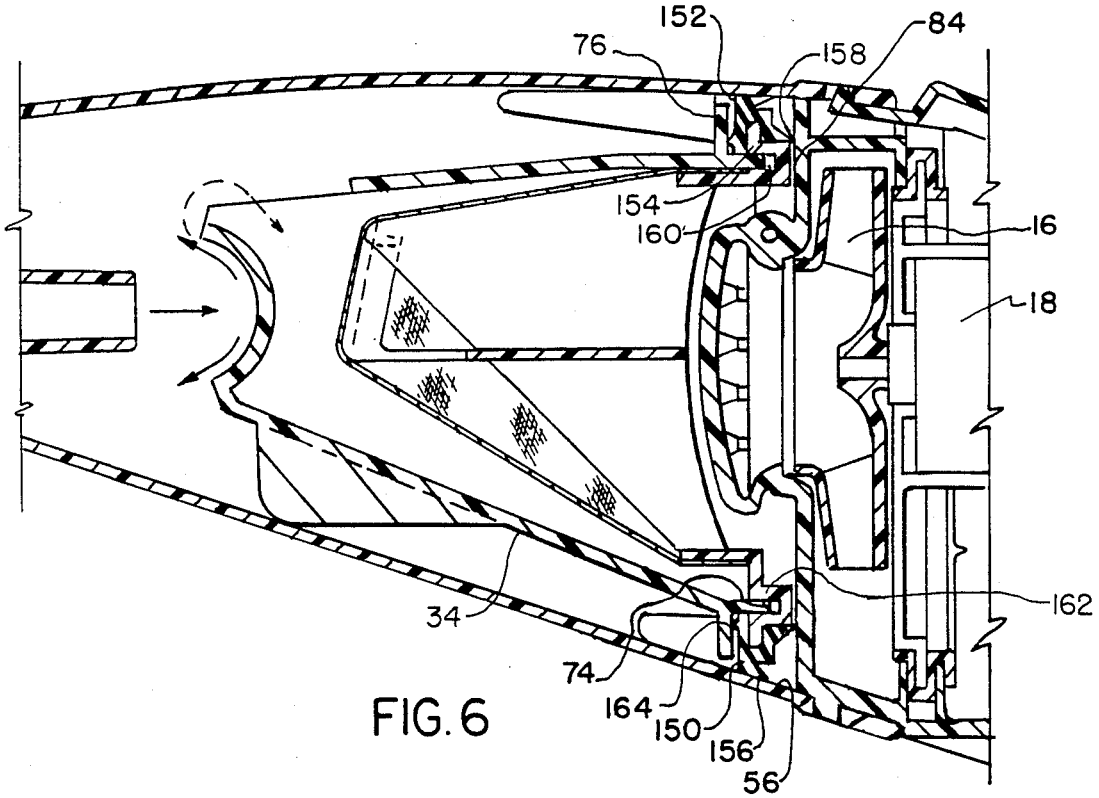
FIG. 6 is a partial cross sectional view of the vacuum cleaner of FIG. 1 with the preferred seal and support member of FIG. 5 assembled therein.

Referring to FIGS. 5 and 6, the preferred embodiment of a seal and support member 150 is illustrated. This was developed for the assignee of the present invention subsequent to applicant's development of the embodiment illustrated in FIGS. 1–4. As can be seen, the seal and support member is substantially the same as the seal and support member 38 illustrated in FIGS. 3 and 4 except that part of the sealing is provided by a flexible and separable ring 152 disposed about flange 154. The ring includes an annular outer lip 156 at its outermost periphery and an annular inner lip 158 disposed radially inwardly of the outer lip. As can be seen in FIG. 6, the ring has a groove 160 for interfitting with the flange. In a manner similar to the arrangement described in FIGS. 3 and 4, the outer lip is deflected to provide a first seal with the collector container interior surface 56 and the inner annular lip provides a second seal with motor/fan housing front wall 84. The separator 34 and the flange also connect together via the separator rim 74 and an annular grooved portion 162 to provide a third seal. The seal ring is provided with an additional annular lip 164, similar to the annular lips 100 of FIGS. 3 and 4 which provided face seals with the motor/fan housing front wall, which provides a seal with the separator flange 76 in a similar manner. Although it is believed other materials could be utilized, the described sealing ring was molded of E.P.D.M. thermoset elastomer material to provide good moldability, flexibility and temperature resistance. The remaining portions of the filter support may be molded as one piece from a material which provides adequate structural support such as, for example, polypropylene.

While there has been shown and described herein preferred embodiments of the present invention, it should be apparent to persons skilled in the art that numerous modifications may be made therein without departing from the true spirit and scope of the invention. Accordingly, it is intended by the appended claims to cover all modifications which come within the spirit and scope of this invention.

What is claimed is:

1. A hand held vacuum cleaner comprising:

a housing including a fan inlet;

a collection container separably attached to said housing and including tubular means therein having an inlet and an outlet for conveying liquid and dirt laden air from a surface being cleaned to the interior of said collection container;

a motor/fan unit located in said housing and in air flow communication with said collection container via the fan inlet, said motor/fan unit producing a flow of dirt and liquid laden air into said collection container via said tubular means;

a liquid separator located within said collection container and elongated in a direction from said tubular means to said housing and interposed therebetween to inhibit liquid flow to said housing and thus provide for liquid storage within the interior of said collection container, said liquid separator having inlet and outlet apertures for providing air communication between the fan inlet and said tubular means; and a baffle within said collection container elongated transversely of said separator and having a generally semicylindrically shaped concave surface positioned opposite the outlet of said tubular means for redirecting liquid and dirt laden air emanating from the outlet of said tubular means.

2. The hand held vacuum cleaner of claim 1 wherein said baffle is carried by said liquid separator.

3. The hand held vacuum cleaner of claim 1 wherein said liquid separator includes a front wall having said generally semi-cylindrical shaped concave surface of said baffle formed integrally therewithin.

4. The hand held vacuum cleaner of claim 3 wherein the inlet aperture of said liquid separator is established at least in part by said front wall.

5. The hand held vacuum cleaner of claim 1 wherein said liquid separator includes an annular seal member disposed about a peripheral surface of said liquid separator for inhibiting liquid flow from said collection container to said housing.

6. The hand held vacuum cleaner of claim 5 wherein said liquid separator is separable from said collection container thereby facilitating emptying of liquid and other collected materials from said collection container.

7. The hand held vacuum cleaner of claim 1 further including a filter located within said collection container.

8. The hand held vacuum cleaner of claim 7 wherein said filter comprises a bag filter disposed within and generally coextensive with said liquid separator and wherein said baffle redirects liquid emanating from the outlet of said tubular means away from said bag filter.

9. A vacuum cleaner for pick-up of both liquid and dry material comprising:

a housing including a fan inlet;

a collection container separably attached to said housing and including a nozzle opening;

a motor/fan unit located in said housing and in air flow communication with said collection container via the fan inlet, said motor/fan unit producing a flow of dirt and liquid laden air into said collection container via the nozzle opening;

a liquid separator removably disposed within said collection container and having inlet and outlet apertures for providing air flow communication between the nozzle opening and the fan inlet, said liquid separator elongated in a direction from the nozzle opening toward said housing and interposed therebetween to provide for liquid storage with said collection container;

an elongated bag filter disposed within and generally coextensive with said liquid separator; and connection means removably disposed with said collection container for providing a separable sealed connection between said bag filter and said liquid separator.

10. The vacuum cleaner of claim 9 wherein said liquid separator includes a rim and wherein said connection means includes a groove for removably receiving said rim therein.

11. The vacuum cleaner of claim 9 wherein said liquid separator includes a sloped wall and said bag filter includes a tapered surface adjacent to said sloped wall so as to provide space for air flow therebetween.

12. The vacuum cleaner of claim 9 wherein said connection means includes a seal member having resilient annular outer lip for establishing a seal with said collection container and another resilient annular lip disposed radially inwardly of the resilient outer lip for establishing a seal with said housing.

13. The vacuum cleaner of claim 12 wherein said seal member includes a frame for interiorly supporting said bag filter.

14. The vacuum cleaner of claim 12 wherein said seal member is formed of resilient material and includes a groove therein for removably receiving said liquid separator.

15. The vacuum cleaner of claim 9 wherein said bag filter includes an open end, a closed end having an arcuate configuration and a central bottom concave portion sloped from the open end to the closed end.

16. The vacuum cleaner of claim 9 further including a semi-cylindrically shaped concave baffle and wherein said collection container includes tubular means having an inlet and an outlet for conveying dirt and liquid laden air into said collection container, said semi-cylindrically shaped concave baffle interposed between said tubular means and the fan inlet for redirecting dirt and liquid laden air emanating from the outlet of said tubular means.

17. The vacuum cleaner of claim 16 wherein said semi-cylindrically shaped concave baffle is carried by said liquid separator.

* * * * *

US004831685B1

REEXAMINATION CERTIFICATE (2566th)

United States Patent [19]

[11] B1 4,831,685

Bosyj et al.

[45] Certificate Issued May 9, 1995

[54] WET AND DRY VACUUM CLEANER

[75] Inventors: Nick M. Bosyj, North Canton; John A. Leonatti, Uniontown; Vincent L. Weber, Canton; Gregory P. Wagner, Akron, all of Ohio

[73] Assignee: The Hoover Company, North Canton, Ohio

Reexamination Request:
No. 90/003,502, Jul. 21, 1994

Reexamination Certificate for:

| | |
|---|---|
| Patent No.: | **4,831,685** |
| Issued: | **May 23, 1989** |
| Appl. No.: | **126,021** |
| Filed: | **Nov. 27, 1987** |

[51] Int. Cl.[6] ..... A47L 5/24; A47L 9/12; A47L 9/18

[52] U.S. Cl. ..... 15/344; 15/347; 15/353; 55/332; 55/373; 55/DIG. 2; 55/DIG. 3

[58] Field of Search ..... 15/344, 347, 350, 352, 15/353; 55/332, 334, 372, 373, 464, DIG. 2, DIG. 3

[56] References Cited

U.S. PATENT DOCUMENTS

| | | | |
|---|---|---|---|
| 2,191,717 | 2/1940 | Jeffery . | |
| 2,539,195 | 1/1951 | Lang . | |
| 2,639,005 | 5/1953 | Gerstmann . | |
| 2,737,263 | 3/1956 | Anderson . | |
| 2,792,076 | 5/1957 | Meyerhoefer . | |
| 3,267,511 | 8/1966 | Meyerhoefer | 15/353 |
| 3,618,297 | 11/1971 | Hamrick | 55/216 |
| 4,055,405 | 10/1977 | Thun-Hohenstein | 15/353 X |
| 4,533,371 | 8/1985 | Nakamura | 55/299 |
| 4,542,557 | 9/1985 | Levine | 15/344 |
| 4,547,206 | 10/1985 | Sovis | 55/255 |

FOREIGN PATENT DOCUMENTS

| | | |
|---|---|---|
| 170720 | 2/1986 | European Pat. Off. . |
| 782202 | 9/1957 | United Kingdom . |
| 990065 | 4/1965 | United Kingdom . |

*Primary Examiner*—Chris K. Moore

[57] ABSTRACT

A filter, separator and seal arrangement is disclosed for a wet and dry hand held vacuum cleaner. A cup-shaped filter is provided which is elongated to provide a large area for enhancing sustained air performance of the cleaner with the filter being disposed within a liquid separator so as to be generally coextensive therewith. A connection arrangement is also provided between the filter and separator so as to provide an air tight and liquid tight connection therebetween but which is also easily separable to facilitate cleaning of the two devices.

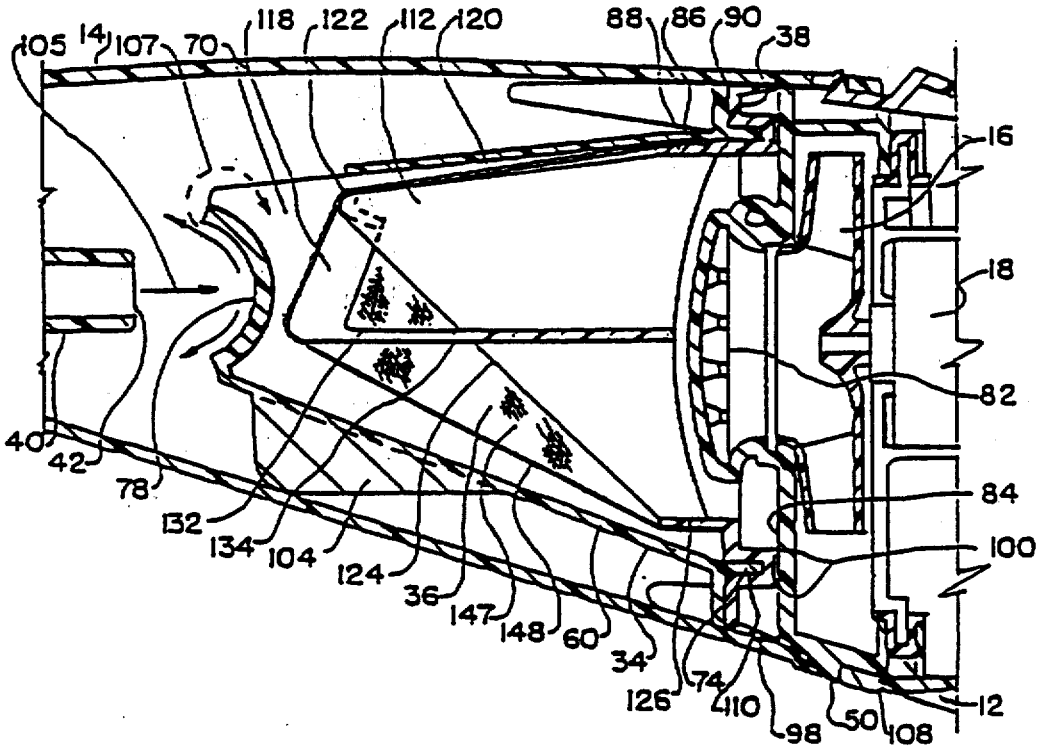

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-17 is confirmed.

* * * * *